US008948646B2

(12) United States Patent
Miyake et al.

(10) Patent No.: US 8,948,646 B2
(45) Date of Patent: Feb. 3, 2015

(54) ELECTROPHOTOGRAPHIC IMAGE FORMING APPARATUS

(71) Applicant: Samsung Electronics Co., Ltd., Suwon-si, Gyeonggi-do (KR)

(72) Inventors: Koji Miyake, Yokohama (JP); Takayuki Wakai, Yokohama (JP)

(73) Assignee: Samsung Electronics Co., Ltd., Suwon-Si (KR)

( * ) Notice: Subject to any disclaimer, the term of this patent is extended or adjusted under 35 U.S.C. 154(b) by 237 days.

(21) Appl. No.: 13/706,927

(22) Filed: Dec. 6, 2012

(65) Prior Publication Data

US 2013/0149001 A1 Jun. 13, 2013

(30) Foreign Application Priority Data

Dec. 8, 2011 (JP) ..... 2011-269292
Nov. 30, 2012 (KR) ..... 10-2012-0138506

(51) Int. Cl.
*G03G 15/02* (2006.01)

(52) U.S. Cl.
CPC ..... *G03G 15/0225* (2013.01); *G03G 15/0233* (2013.01)
USPC ..... 399/100; 399/176

(58) Field of Classification Search
USPC ..... 399/100, 176; 492/33; 29/895.32, 29/895.33
See application file for complete search history.

(56) References Cited

FOREIGN PATENT DOCUMENTS

| | | |
|---|---|---|
| JP | 8-62949 | 3/1996 |
| JP | 2011-95725 | 5/2011 |
| JP | 2011-191610 | 9/2011 |
| JP | 2011-232433 | 11/2011 |

*Primary Examiner* — Walter L Lindsay, Jr.
*Assistant Examiner* — Ruth Labombard
(74) *Attorney, Agent, or Firm* — Staas & Halsey LLP

(57) ABSTRACT

An electrophotographic image forming apparatus includes a photoreceptor forming an electrostatic latent image on a surface thereof, a charging roller being in contact with the photoreceptor to uniformly charge the surface thereof, a developing device forming a toner image on the photoreceptor, and a cleaning device cleaning contaminants on a surface of the charging roller, in which the charging roller has a conductive elastic layer formed around an axis and a direction of polishing marks on the surface of the charging roller is in a circumferential direction.

9 Claims, 3 Drawing Sheets

ELECTROPHOTOGRAPHIC IMAGE FORMING APPARATUS

CROSS-REFERENCE TO RELATED APPLICATIONS

This application claims the benefit of Japanese Patent Application No. 2011-269292, filed on Dec. 8, 2011, in the Japanese Patent Office, and Korean Patent Application No. 10-2012-138506, filed on Nov. 30, 2012, in the Korean Intellectual Property Office, the disclosures of which are incorporated herein in their entirety by reference.

BACKGROUND

1. Field

The present disclosure relates to an electrophotographic image forming apparatus and more particularly, to an electrophotographic image forming apparatus using a contact charging device.

2. Description of the Related Art

A charging device having the shape of a roller using a rubber layer around a shaft is used as a contact charging device. The roller is in pressure contact with a photoreceptor drum by own weight or a load to form a microscopic gap and a surface of the photoreceptor drum is uniformly charged by electrical discharge from a portion thereof. The drum, for example, is formed of an organic photo-conductor (OPC).

A charging method may be classified as an alternating current (AC) charging method, in which an alternating current is in superposition of a direct current (DC), and a DC charging method using only a direct current. The AC method has excellent stability, but has high discharge stress, and the AC method is disadvantageous in view of lifetime accompanying the generation of discharge products or deterioration of the surface of a photoreceptor drum. The DC method has low stability, but is excellent in view of total costs including the lifetime and environmentally friendly characteristics (so-called "eco characteristics"). Recently, the DC charging method typically limited to a low-printing rate region has been deployed in a high-printing rate region.

In general, a charging roller is polished by sliding a whetstone in an axial direction when the shape thereof is trimmed in a fabrication process. At this time, in order to more stably maintain a nib, uniform charging is performed by using a roller having low surface roughness, in which roughness is minimized by the improvement of polishing accuracy or coating.

A surface of the charging roller is contaminated by external additives of a toner. Charge stains that are generated due to the contamination appear as vertical stripes in an image. In order to remove the vertical stripes, cleaning is performed by allowing a sponge roller to be rotated in contact with the charging roller.

For example, a charging roller according to the prior art is described in Japanese Patent Publication No. 08-062949.

With respect to DC charging, since chargeability is low, many lateral stripes are frequently generated in a halftone image. These microscopic stains are denoted as microjitter. Microjitter is caused by microscopic charge defects or electrical discharge due to polishing marks on the surface of the charging roller.

In particular, with respect to a type in which a charging roller is in pressure contact with a photoreceptor drum, electrical discharge or charge defects are more facilitated due to the instability of the nib. Therefore, a measure of reducing the possibility of the generation of electrical discharge or charge defects by uniformizing the nib through smoothing the surface thereof as much as possible was typically selected. However, when the surface is smoothed, a decrease in a rotation performance of the charging roller driven by the photoreceptor or an effect of peeling electrification may not be ignored.

SUMMARY

The present disclosure provides an apparatus able to promote both the decrease of the generation frequency of microjitter and the prevention of the contamination of a charging roller.

According to the present disclosure, a polishing direction of a surface of the charging roller is set as a circumferential direction. Therefore, charge defects in an axial direction may be prevented. Peeling electrification is prevented by increasing roughness of the charging roller.

When the polishing direction is set as the circumferential direction, imbalance in cleaning performance may be generated due to uneven grooves of the surface. In order to prevent this, cleaning performance may be improved by optimizing a cleaning roller with respect to the charging roller.

Additional aspects and/or advantages will be set forth in part in the description which follows and, in part, will be apparent from the description, or may be learned by practice of the disclosure.

According to an aspect of the present disclosure, there is provided an electrophotographic image forming apparatus including: a photoreceptor forming an electrostatic latent image on a surface thereof; a charging roller being in contact with the photoreceptor to uniformly charge the surface thereof, a developing device forming a toner image on the photoreceptor; and a cleaning device cleaning contaminants on a surface of the charging roller, wherein the charging roller has a conductive elastic layer formed around an axis and a direction of polishing marks on the surface of the charging roller is in a circumferential direction.

A ten point average roughness (Rzjis) of the surface of the charging roller may be in a range of about 10 μm or more to about 25 μm or less.

The ten point average roughness (Rzjis) of the surface of the charging roller and an average particle diameter (Dt) of a toner may satisfy a relationship of Rzjis≥Dt.

The average particle diameter (Dt) of the toner may be in a range of about 3 μm or more to about 10 μm or less.

The cleaning device may include a cleaning roller being in contact with the charging roller and having a porous elastic layer around an axis, and an average cell diameter (Dx) in an axial direction of foamed cells in the porous elastic layer and an average length (RSm) of curved elements in surface roughness of the charging roller may satisfy a relationship of Dx>RSm.

A contact depth (Cd) between the cleaning roller and the charging roller and the ten point average roughness (Rzjis) of the charging roller may satisfy a relationship of Cd≥2Rzjis.

The cleaning roller may be driven by the charging roller.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION

Figure 1:
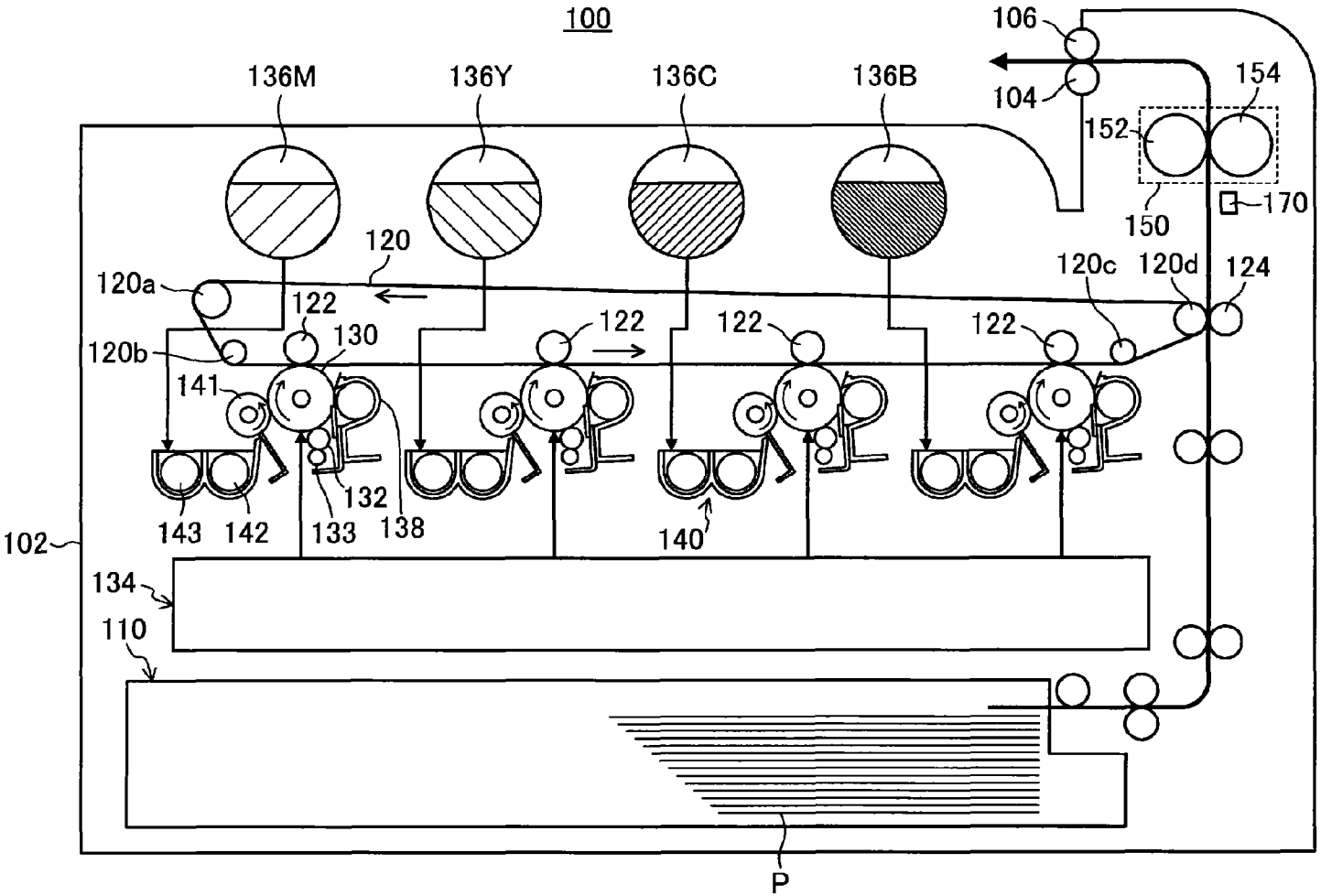
FIG. 1 is a schematic view illustrating an electrophotographic image forming apparatus using a contact charging device according to an embodiment of the present disclosure.

The present disclosure will now be described more fully with reference to the accompanying drawings, in which exemplary embodiments of the present disclosure are shown.

A contact charging device according to an embodiment of the present disclosure will be described in detail with reference to the drawings. In the drawings, like reference numerals refer to like elements throughout.

<Outline of Image Forming Apparatus>

FIG. 1 is a schematic view illustrating an electrophotographic image forming apparatus 100 using a contact charging device according to an embodiment of the present disclosure.

A fixing unit 150 according to the embodiment, for example, may be installed in a tandem-type image forming device illustrated in FIG. 1. As illustrated in FIG. 1, the image forming apparatus 100 may include a recording medium conveying unit 110, a transfer unit including a transfer belt 120 as a primary transfer body, a photoreceptor drum 130 receiving an electrostatic latent image, a developing unit 140 developing the electrostatic latent image formed on the photoreceptor drum 130, and the fixing unit 150.

The recording medium conveying unit 110 accommodates a recording medium on which an image is to be finally formed, and conveys the recording medium to a recording medium conveying path. The recording medium, for example, is paper P and is accommodated by being stacked in a cassette. The recording medium conveying unit 110 allows the paper P to reach a secondary transfer region with timing in which a toner image to be transferred to the paper P reaches the secondary transfer region.

The transfer unit conveys the toner image which is formed by the developing unit 140 to be later described to the secondary transfer region in which the toner image is secondarily transferred to the recording medium. The transfer unit may include a transfer belt 120, suspension rollers 120*a*, 120*b*, 120*c*, and 120*d* suspending the transfer belt 120, a primary transfer roller 122 holding the transfer belt 120 together with the photoreceptor drum 130, and a second transfer roller 124 holding the transfer belt 120 together with the suspension roller 120*d*.

The transfer belt 120 may be a circular belt circulated by the suspension rollers 120*a*, 120*b*, 120*c*, and 120*d*. The primary transfer roller 122 is installed to pressurize the photoreceptor drum 130 from an inner circumferential side of the transfer belt 120. Meanwhile, the secondary transfer roller 124 is installed to pressurize the suspension roller 120*d* from an outer circumferential side of the transfer belt 120. Also, although not illustrated in FIG. 1, the transfer unit may further include a belt cleaning device removing a toner adhered to the transfer belt 120.

The photoreceptor drum 130, as an electrostatic latent image carrier having an image formed on a circumferential surface thereof, may be, for example, formed of an organic photo-conductor. The image forming apparatus 100 according to the embodiment is an apparatus able to form a color image, in which four photoreceptor drums 130 corresponding to each color, e.g., magenta, yellow, cyan, and black, are installed in a rotation direction of the transfer belt 120. As illustrated in FIG. 1, a charging roller 132, an exposure unit 134, a developing unit 140, and a cleaning unit 138 are arranged along the circumference of the photoreceptor drum 130.

The charging roller 132 uniformly charges a surface of the photoreceptor drum 130 at a predetermined potential. The exposure unit 134 exposes the surface of the photoreceptor drum 130 charged by the charging roller 132 according to an image to be formed. Therefore, potential in a portion exposed by the exposure unit 134 among the surface of the photoreceptor drum 130 is changed to form an electrostatic latent image. The developing unit 140 develops the electrostatic latent image formed on the photoreceptor drum 130 with toners supplied by toner tanks 136M, 136Y, 136C and 1368 to form a toner image.

Figure 2:
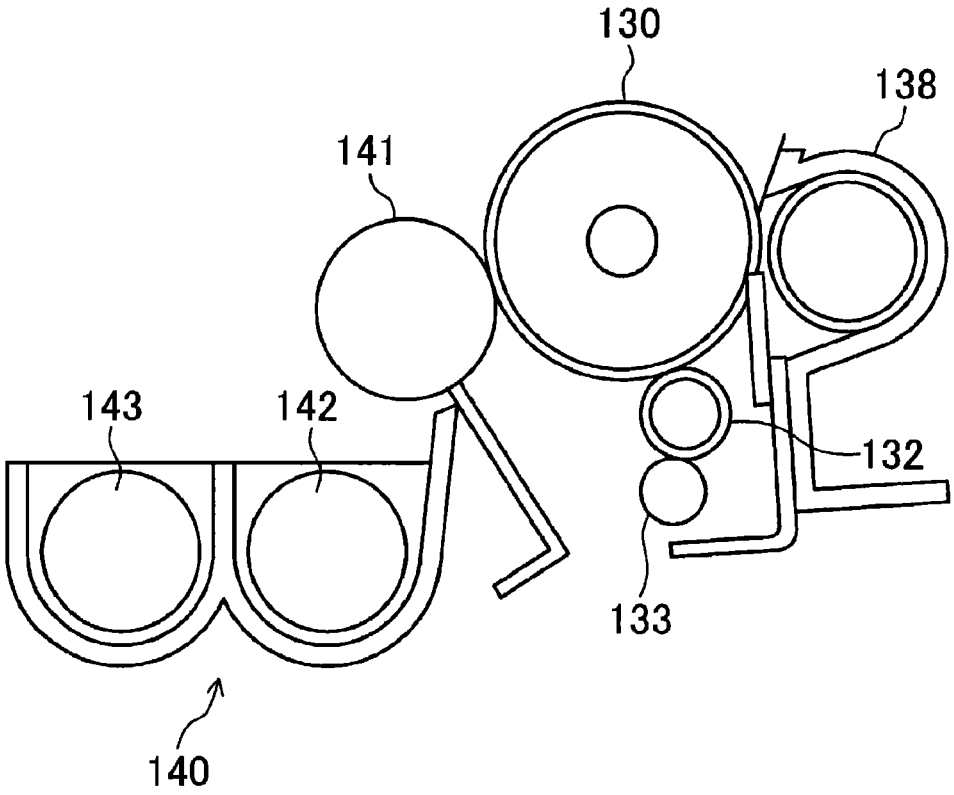
FIG. 2 more specifically illustrates a photoreceptor drum, a charging roller, and a cleaning roller of the image forming apparatus in FIG. 1.

A cleaning roller 133 removes contaminants adhered to a surface of the charging roller 132. Specifically, the charging roller 132 may be contaminated by external additives externally added to the toner. Therefore, the cleaning roller 133 removes the external additives adhered to the charging roller 132. FIG. 2 more specifically illustrates the photoreceptor drum 130, the charging roller 132, and the cleaning roller 132 of the image forming apparatus 100 in FIG. 1.

A toner image formed on the photoreceptor drum 130 is primarily transferred to the transfer belt 120 and a cleaning unit 138 then recovers a toner remaining on the photoreceptor drum 130. For example, the cleaning unit 138 may be configured to remove the toner remaining on the photoreceptor drum 130 by providing a cleaning blade to be in contact with the circumferential surface of the photoreceptor drum 130. In addition, a charge erase lamp (not shown) resetting the potential of the photoreceptor drum 130 may be disposed between the cleaning unit 138 and the charging roller 132 along the circumference of the photoreceptor drum 130 with respect to the rotation direction of the photoreceptor drum 130.

The developing unit 140 may include a developing roller 141 and stirring and conveying parts 142 and 143. The developing roller 141 is a developer carrier supplying a toner to the latent image formed on the circumferential surface of the photoreceptor drum 130. The stirring and conveying parts 142 and 143 stir magnetic carriers and a non-magnetic or low-magnetic toner constituting a developer to charge the carriers and the toner. A first stirring and conveying part 142 is disposed by facing the developing roller 141 in an approximately vertical direction and provides the mixed and stirred developer to the developing roller 141. A second stirring and conveying part 143 plays a role to sufficiently charge the developer by mixing and stirring the developer and conveys the charged developer to the first stirring and conveying part 142. A toner concentration sensor (not shown) for detecting a concentration of the toner may be installed in the second stirring and conveying part 143. The developer may be supplied from the toner tanks 136 to the conveying path when the concentration of the toner in the conveying path is decreased.

The fixing unit 150 fixes the toner image secondarily transferred from the transfer belt 120 to the recording medium by attaching the toner image to the recording medium. For example, the fixing unit 150 may include a heating roller 152 and a pressurizing roller 154. The heating roller 152, acting as a fixing roller, may be a cylindrical member rotatable around the rotation axis, in which a heat source, such as a halogen lamp, is installed in the inside thereof. The pressurizing roller 154 may be a cylindrical member rotatable around a rotation axis and installed to pressurize the heating roller 152. A heat resistant elastic layer, such as a silicon rubber, is formed on outer circumferential surfaces of the heating roller 152 and the pressurizing roller 154. The recording medium is passed through a fixing nib portion which is a contact region between the heating roller 152 and the pressurizing roller 154, and thus, the toner image is heat-fixed onto the recording medium.

In addition, a feed sensor 170 detecting a feeding state of the recording medium may be installed between the fixing unit 150 and the secondary transfer region where the toner image is secondarily transferred from the transfer belt 120 to the recording medium. The feed sensor 170 detects whether the recording medium is passed through a position in which the feed sensor 170 is installed. Also, the fixing unit 150 according to the embodiment includes a pressure varying device (not illustrated) adjusting applied pressure between the heating roller 152 and the pressurizing roller 154.

Further, discharge rollers 104 and 106 for discharging the recording medium having the toner image fixed thereon by the fixing unit 150 to the outside of the apparatus housing 102 may be installed in the image forming apparatus 100.

In the image forming apparatus 100, a recorded image signal is first transmitted to a controller (not shown) when the image forming apparatus 100 is operated. Thereafter, the controller uniformly charges the surface of the photoreceptor drum 130 at a predetermined potential by using the charging roller 132 and then forms an electrostatic latent image by irradiating the surface of the photoreceptor drum 130 with a laser beam based on the received image signal by using the exposure unit 134.

In the developing unit 140, a toner and carriers are mixed and stirred to be sufficiently charged and a developer is attached to the developing roller (see 141 in FIG. 1). When the developer is conveyed to a region facing the photoreceptor drum 130 by the rotation of the developing roller 141, the toner in the developer attached to the developing roller 141 is transferred to the electrostatic latent image formed on the circumferential surface of the photoreceptor drum 130 to thus develop the electrostatic latent image. A toner image thus formed is primarily transferred from the photoreceptor drum 130 to the transfer belt 120 in a region in which the photoreceptor drum 130 and the transfer belt 120 are faced to each other. Toner images formed on the four photoreceptor drums 130 are sequentially stacked to form a stacked toner image on the transfer belt 120. The stacked toner image is secondarily transferred from the transfer belt 120 to the recording medium fed from the recording medium conveying unit 110, in a region in which the suspension roller 120*d* and the secondary transfer roller 124 are facing each other.

The recording medium having the stacked toner image secondarily transferred thereon is conveyed to the fixing unit 150. The recording medium is passed between the heating roller 152 and the pressurizing roller 154 while heat and pressure are applied, and thus, the stacked toner image is heat-fixed onto the recording medium. Thereafter, the recording medium is discharged to the outside of the image forming apparatus 100 by the discharging rollers 104 and 106. Meanwhile, in the case that a belt cleaning device is included, a toner remaining on the transfer belt 120 after the stacked toner image is secondarily transferred to the recording medium is removed by the belt cleaning device.

In addition, the tandem-type image forming apparatus 100 illustrated in FIG. 1 is an example of the image forming apparatus using the fixing unit 150 according to the embodiment. The fixing unit 150 according to the embodiment may be used for various types of image forming apparatuses.

<Polishing Marks of Charging Roller>

Figure 3:
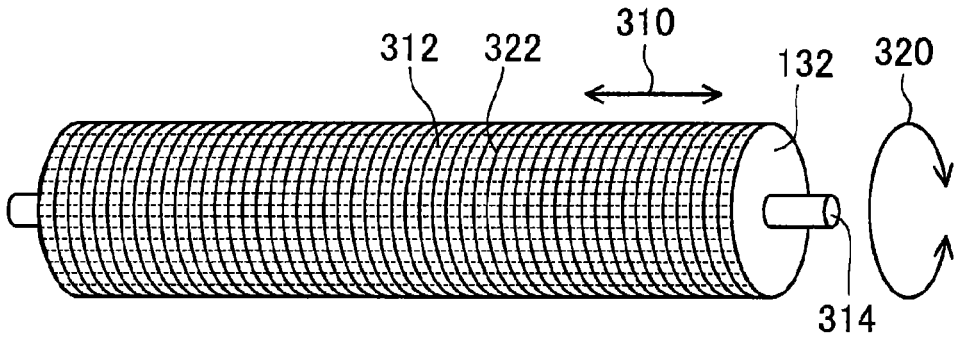
FIG. 3 illustrates polishing marks of the charging roller according to the present disclosure.

FIG. 3 illustrates polishing marks of the charging roller 132 according to the present disclosure. The charging roller 132 has a conductive elastic layer formed around an axis 314.

In a fabrication process, a molding process or a vulcanizing process is performed and a shape of the charging roller 132 is then trimmed by polishing. The charging roller 132 is configured to nip into the photoreceptor drum 130 by being loaded with springs at both end portions thereof. In this configuration, since the charging roller 132 may be bent, a center portion of the charging roller 132 may be spaced apart from the photoreceptor drum 130, and as a result, uniform charging may not be secured. In order to achieve uniform charging, the charging roller 132 may be formed to have a crown shape (also called as "barrel type"), in which a diameter of the center portion thereof is greater than those of the both end portions thereof. In order to prepare the foregoing shape, polishing is performed by moving a whetstone for polishing in an axial direction 310 of the charging roller 132 while the charging roller 132 is rotated. As a result of polishing in the axial direction, polishing marks 312 along the axial direction 310 are generated on the surface of the charging roller 132.

According to the present disclosure, polishing in a circumferential direction 320 of the charging roller 132 is performed after polishing in the axial direction. Therefore, since the polishing marks 312 along the axial direction are erased, polishing marks 322 along the circumferential direction 320 finally remain on the charging roller 132. That is, according to the present disclosure, polishing marks are changed from the axial direction to the circumferential direction. At this time, a cross section of the charging roller 132 along the axial direction exhibits unevenness.

When an applied voltage value increases in DC charging, a microscopic discharge may occur between the charging roller 132 and the photoreceptor drum 130 in a range more than a predetermined voltage value (called "discharge start voltage"). The surface of the photoreceptor drum 130 is charged by power of the discharge. The discharge start voltage may greatly depend on a surface state of the charging roller 132.

When the charging roller is polished in the prior art, polishing is performed by sliding a whetstone. Therefore, in a typical charging roller, polishing marks are generated in an axial direction. The polishing marks in the axial direction become a cause of microjitter.

For example, since moisture is absorbed on the polishing marks of the surface of the charging roller in a high-temperature and high-humidity environment, a microscopic leakage current may flow. Charge defects may occur due to the leakage current. In contrast, in a low-temperature and low-humidity environment, a portion of the polishing marks acts as a microscopic gap between the charging roller 132 and the photoreceptor drum 130. As a result, an abnormal discharge may occur and thus, excessive charging may occur. Microscopic lateral stripes may be generated in a developed image due to the foregoing phenomenon. According to the present disclosure, the generation of the lateral stripes may be prevented by polishing the charging roller 132 in the circumferential direction.

When a pitch of the polishing marks in the circumferential direction is relatively small, the polishing marks in the axial direction may not be sufficiently erased. Also, peeling electrification may occur between adjacent protrusions of the cross section in the axial direction particularly when moving away from the photoreceptor drum 130, and thus, new microjitter may be generated. Therefore, the pitch of the polishing marks in the cross section in the axial direction may be set to be sufficiently wide.

<Ten Point Average Roughness (Rzjis) of Charging Roller>

In the image forming apparatus 100 according to the present disclosure, a ten point average roughness (Rzjis) of the surface of the charging roller 132 may be in a range of 10 μm or more to 25 μm or less. As a result, quality of the formed image may be improved.

According to an embodiment of the present disclosure, the ten point average roughness (Rzjis) of the charging roller 132 and an average particle diameter Dt of the toner satisfy a relationship of Rzjis≥Dt. As a result, an effect, in which the charging roller 132 is not easily contaminated by the toner, may be obtained. In this case, the average particle diameter Dt of the toner may be in a range of 3 μm or more to 10 μm or less. When the average particle diameter Dt of the toner is in the above range, the effect, in which the charging roller 132 is not easily contaminated by the toner, may be increased.

Surface property parameters used in the present specification, such as the ten point average roughness (Rzjis), are in accordance with the JIS B0601-2001.

<Cleaning Roller>

The surface of the charging roller 132 may be contaminated by external additives of the toner. In order to remove the contaminants, the cleaning roller 133 is in pressure contact with the surface of the charging roller 132 and driven by the charging roller 132. Therefore, the cleaning roller 133 cleans the surface of the charging roller 132. More particularly, the cleaning roller 133 may decrease adhesion by agglomerating the external additives of the toner attached to the surface of the charging roller 132 to electrically reattach the external additives to the photoreceptor drum 130. Thereafter, the external additives reattached to the photoreceptor drum 130 are recovered by a cleaning member (e.g., urethane blade). Since the cleaning roller 133 is driven by the charging roller 132, a separate driving device for the cleaning roller 133 may not be provided.

The cleaning roller 133 has a porous elastic layer on the surface thereof. Examples of a material of the elastic layer may be a nitrile butadiene rubber (NBR), a hydrin rubber, urethane, and silicon. The elastic layer includes a plurality of foamed cells (i.e., holes) like a sponge.

Figure 4:
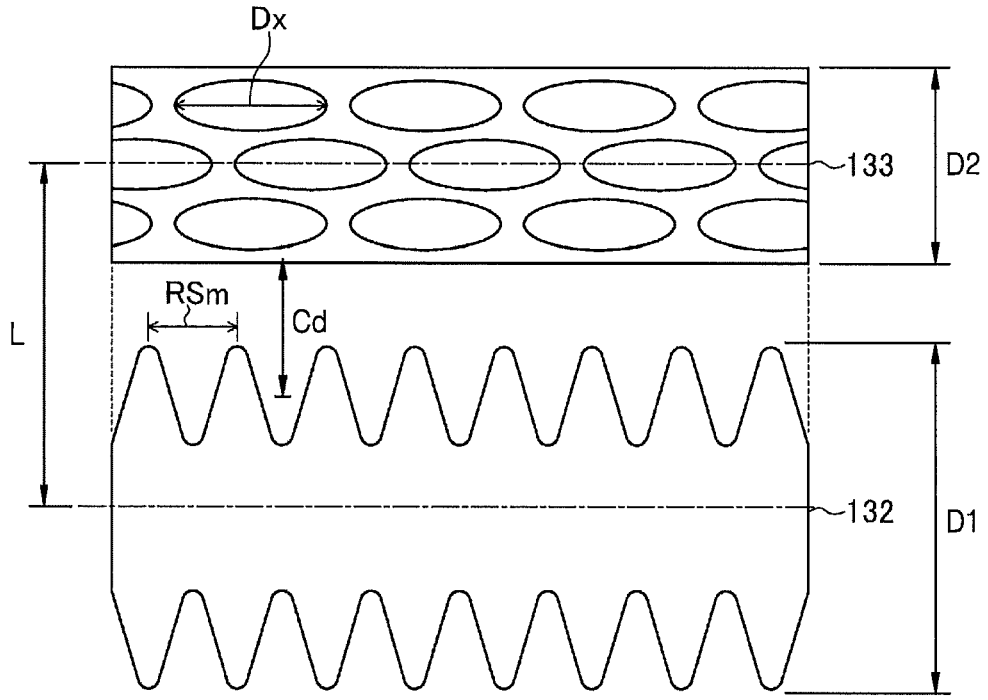
FIG. 4 illustrates emphasized surface shapes of a charging roller and a cleaning roller according to an embodiment of the present disclosure.

FIG. 4 illustrates emphasized surface shapes of a charging roller and a cleaning roller according to an embodiment of the present disclosure.

In the case that the polishing marks are formed in the circumferential direction as described above, entire V-shaped grooves formed in the circumferential direction may not be rubbed, when a diameter of the foamed cells in the elastic layer of the cleaning roller 133 is relatively small, and thus, contaminants may be accumulated. In particular, surface roughness of the charging roller 132 may be increased in order to prevent microjitter. However, in the case that cleaning of the grooves is insufficient, the charge stains may not only be generated, but the effect of increasing the ten point average roughness (Rzjis) may also not be obtained due to the accumulation of the contaminants. Therefore, the diameter of the foamed cells of the cleaning roller 133 is set to be greater than the polishing marks of the charging roller 132.

Specifically, an average cell diameter in the axial direction of the foamed cells in the porous elastic layer of the cleaning roller 133 is denoted as Dx. Also, an average length of curved elements in the surface roughness of the charging roller 132 is denoted as RSm. According to the embodiment of the present disclosure, a relationship of Dx >RSm is satisfied. In the case that the ten point average roughness (Rzjis) of the charging roller 132 is set to be large, i.e., in the case that the surface unevenness of the charging roller 132 is high, the above relationship may be satisfied in order to completely clean the external additives attached to the increased unevenness. By satisfying the above relationship, superior cleaning may be realized. According to the foregoing features, effects due to the polishing marks in the axial direction may be removed and a leakage current or an abnormal charge may not occur, and thus, the generation of microjitter may be prevented. The generation of microjitter may be decreased and simultaneously, the generation of charge stains due to the contamination of the charging roller may be prevented. As a result, a high quality image may be formed and at the same time, the contamination of the charging roller 132 may be prevented.

The cleaning roller 133 may be relatively soft according to the foregoing configuration. Also, the inside of the grooves in the circumferential direction of the charging roller 132 may be completely cleaned by the foamed cells of the cleaning roller 133.

When a contact depth between the cleaning roller 133 and the charging roller 132 is denoted as Cd, the contact depth (Cd) and the ten point average roughness (Rzjis) of the charging roller 132 satisfy a relationship of Cd≥2Rzjis according to an embodiment. As a result, better cleaning may be realized. In the case that a diameter of the charging roller 132 is denoted as D1, a diameter of the cleaning roller 133 is denoted as D2, and a distance between a shaft center of the charging roller and a shaft center of the cleaning roller is denoted as L, the contact depth (Cd) is expressed as Cd=(D1+D2)/2−L.

As understood by those skilled in the art, a part of the foregoing various elements may be omitted. On the contrary, additional elements may be used.

While the present disclosure has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An electrophotographic image forming apparatus comprising:

a photoreceptor forming an electrostatic latent image on a surface thereof;

a charging roller being in contact with the photoreceptor to uniformly charge the surface thereof;

a developing device forming a toner image on the photoreceptor; and a cleaning device cleaning contaminants on a surface of the charging roller, wherein the charging roller has a conductive elastic layer formed around an axis and a direction of polishing marks on the surface of the charging roller is in a circumferential direction.

2. The electrophotographic image forming apparatus of claim 1, wherein a ten point average roughness (Rzjis) of the surface of the charging roller is in a range of 10 μm or more to 25 μm or less.

3. The electrophotographic image forming apparatus of claim 1, wherein the ten point average roughness (Rzjis) of the surface of the charging roller and an average particle diameter (Dt) of a toner satisfy a relationship of Rzjis≥Dt.

4. The electrophotographic image forming apparatus of claim 3, wherein the average particle diameter (Dt) of the toner is in a range of 3 μm or more to 10 μm or less.

5. The electrophotographic image forming apparatus of claim 1, wherein the cleaning device comprises a cleaning roller being in contact with the charging roller and having a porous elastic layer around an axis, and an average cell diameter (Dx) in an axial direction of foamed cells in the porous elastic layer and an average length (RSm) of curved elements in surface roughness of the charging roller satisfy a relationship of Dx>RSm.

6. The electrophotographic image forming apparatus of claim 5, wherein a contact depth (Cd) between the cleaning roller and the charging roller and the ten point average roughness (Rzjis) of the charging roller satisfy a relationship of Cd≥2 Rzjis.

7. The electrophotographic image forming apparatus of claim 6, wherein the cleaning roller is driven by the charging roller.

8. A charging roller for an electrophotographic image forming apparatus, comprising:

a conductive elastic layer formed around an axis, wherein a surface of the conductive elastic layer is polished to have polishing marks formed in a circumferential direction.

9. The charging roller of claim 8, wherein a ten point average roughness (Rzjis) of the surface of the charging roller is in a range of 10 μm or more to 25 μm or less.

* * * * *